US006499193B1

(12) United States Patent
Robert

(10) Patent No.: US 6,499,193 B1
(45) Date of Patent: Dec. 31, 2002

(54) REMOVABLE HANDLE FOR CASKET

(75) Inventor: Pascal Robert, Norbertville (CA)

(73) Assignee: Victoriaville Funeral Supplies, Inc. (CA)

( * ) Notice: Subject to any disclaimer, the term of this patent is extended or adjusted under 35 U.S.C. 154(b) by 82 days.

(21) Appl. No.: 09/698,524

(22) Filed: Oct. 30, 2000

(51) Int. Cl.[7] ..... A45C 7/00; A45F 5/10
(52) U.S. Cl. ..... 16/445; 16/424; 16/438
(58) Field of Search ..... 16/445, 446, 412, 16/413, 422, 424, 429, 418, 438

(56) References Cited

U.S. PATENT DOCUMENTS

| | | | | | |
|---|---|---|---|---|---|
| 4,077,096 | A | * | 3/1978 | Christian | 16/439 |
| 4,115,669 | A | * | 9/1978 | Cali | 16/429 |
| 4,825,505 | A | * | 5/1989 | Witte | 16/425 |
| 5,005,255 | A | * | 4/1991 | Pare et al. | 16/429 |
| 5,008,990 | A | * | 4/1991 | Craft | 16/439 |
| 5,485,654 | A | * | 1/1996 | Nespodzany, Jr. | 16/422 |
| 5,519,923 | A | * | 5/1996 | Rojdev et al. | 16/422 |
| 5,898,980 | A | * | 5/1999 | Havranek et al. | 16/424 |

FOREIGN PATENT DOCUMENTS

| | | |
|---|---|---|
| DE | 36 40 935 | 6/1988 |
| DE | 41 14 441 | 7/1992 |
| DE | 42 04 617 | 8/1993 |
| DE | 42 39 397 | 9/1993 |

* cited by examiner

*Primary Examiner*—Chuck Y. Mah
(74) *Attorney, Agent, or Firm*—St. Onge Steward Jonston & Reens

(57) ABSTRACT

The present invention concerns a removable handle assembly for a casket which can secure the handles from the inside of the casket for more solidity and, to provide removable handles such as to facilitate the casket's incineration. The removable handle assembly according to the invention includes at least one anchorage having a front and a back side, the back side being adapted to be fixedly secured to a surface, each of the at least one anchorage further having two opposite ends. The assembly also includes at least one removable support adapted to mate with the front side of each of the at least one anchorage; and a lock for locking each of the at least one support on the front side of each of the at least one anchorage. The assembly is completed with a handle pivotally connected to each of the at least one support.

20 Claims, 8 Drawing Sheets

REMOVABLE HANDLE FOR CASKET

FIELD OF THE INVENTION

The present invention relates to a removable handle mechanism, and more particularly, to a removable handle for caskets.

BACKGROUND OF THE INVENTION

The manufacturer of casket furniture faces peculiar problems. His products are used only once and then burnt or buried, so that logic dictates they should be of the cheapest and most ephemeral kind. But the mores of (at least) Western contemporary society have, for quite sometime, required funerary furnishings to be of a quality proportional to the status of the deceased party.

It is common practice, in the casket industry, to use handles that are not removable. The reason is that the weight of the casket requires strong handles to be used. These handles are either integral with the casket or they are bolted from the inside of the casket.

Another criteria discerning in the choice of handles in the casket industry is their aesthetic look. The handle design must be in good taste. Thus, it is readily apparent that cheap-looking removable handles would be unacceptable for most clients.

SUMMARY OF THE INVENTION

An object of the present invention is to achieve almost contradicting demands for casket handles. Namely, to secure the handles from the inside of the casket for more solidity and, to provide removable handles such as to facilitate the casket's incineration.

Another object of the present invention is to provide a reusable and resistant handle for a casket.

More precisely, the above mentioned objects of the present invention are met with a removable handle mechanism, comprising:

- at least one anchorage having a front and a back side, the back side adapted to be fixedly secured to a surface, each of the at least one anchorage further having two opposite ends,
- at least one removable support adapted to mate with the front side of each of the at least one anchorage;
- a lock for locking each of the at least one support on the front side of each of said at least one anchorage; and
- a handle pivotally connected to each of the at least one support.

In an alternative preferred embodiment, the anchorage may be integrally formed with the surface thereby forming a receiving surface.

An advantage of the invention is that it allows repeated use of the handles once a casket is buried or incinerated.

Another advantage of the invention is that the handle mechanism is strong enough to withstand the weight of the casket.

A further advantage of the invention is that the handle is easily removable and has a feature that prevents the handle from falling down while removing it from the casket.

BRIEF DESCRIPTION OF THE DRAWINGS

The present invention will be better understood after reading a description of preferred embodiment thereof, made with reference to the following drawings in which.

DETAILED DESCRIPTION OF THE INVENTION

One of the objects of the present invention is to provide a removable handle for a casket. One characteristic of a removable handle is that it should be solidly fixed to the casket, and yet not be removable from the inside of the casket. This is an important consideration, since in a number of societies, it is not permitted to penetrate inside the casket to remove the handle. Consequently, the mechanism to remove the handle must be accessible from the outside of the casket, and be discreet.

Figure 1:
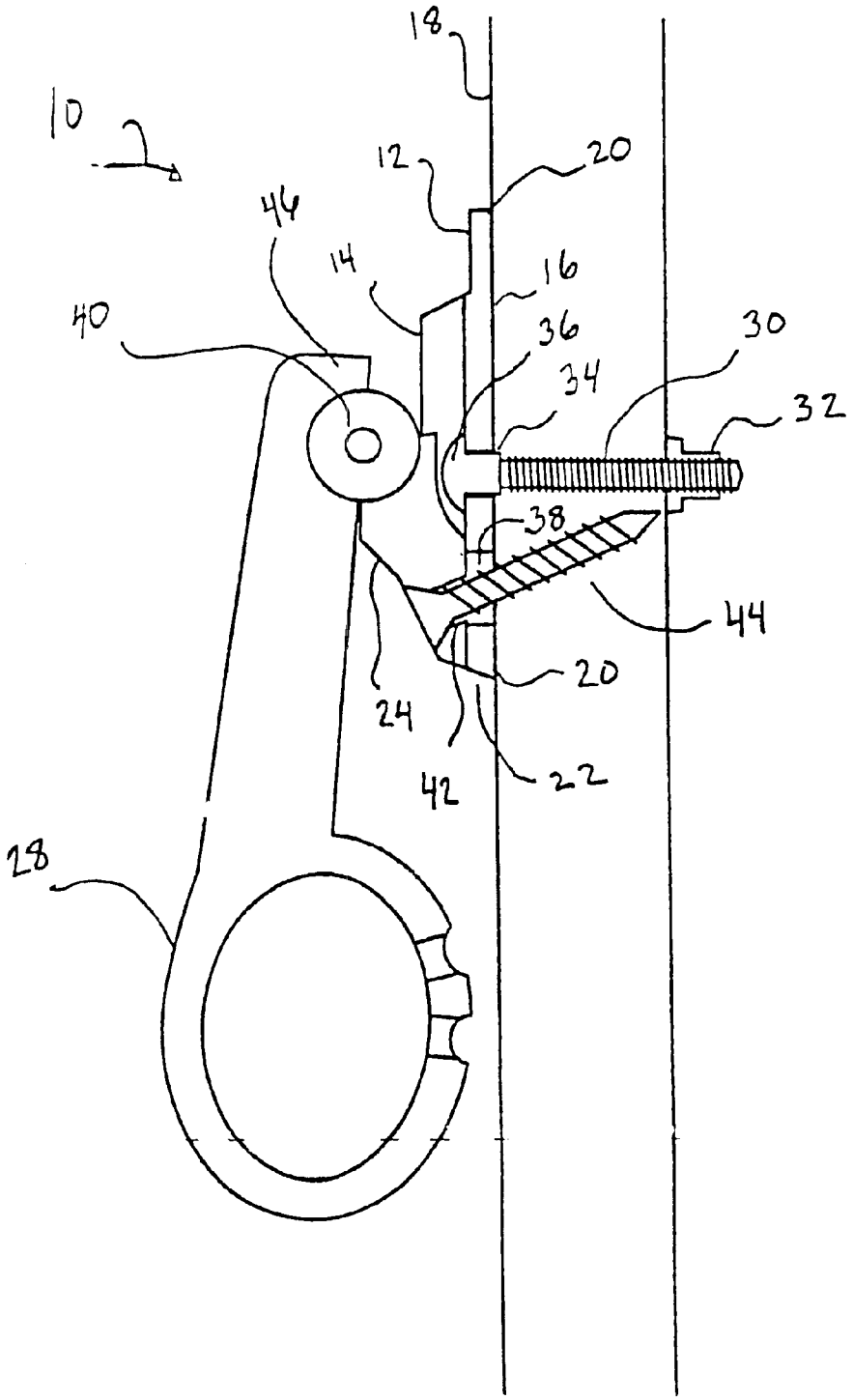
FIG. 1 is a side elevation view of the handle mechanism.
Figure 5:
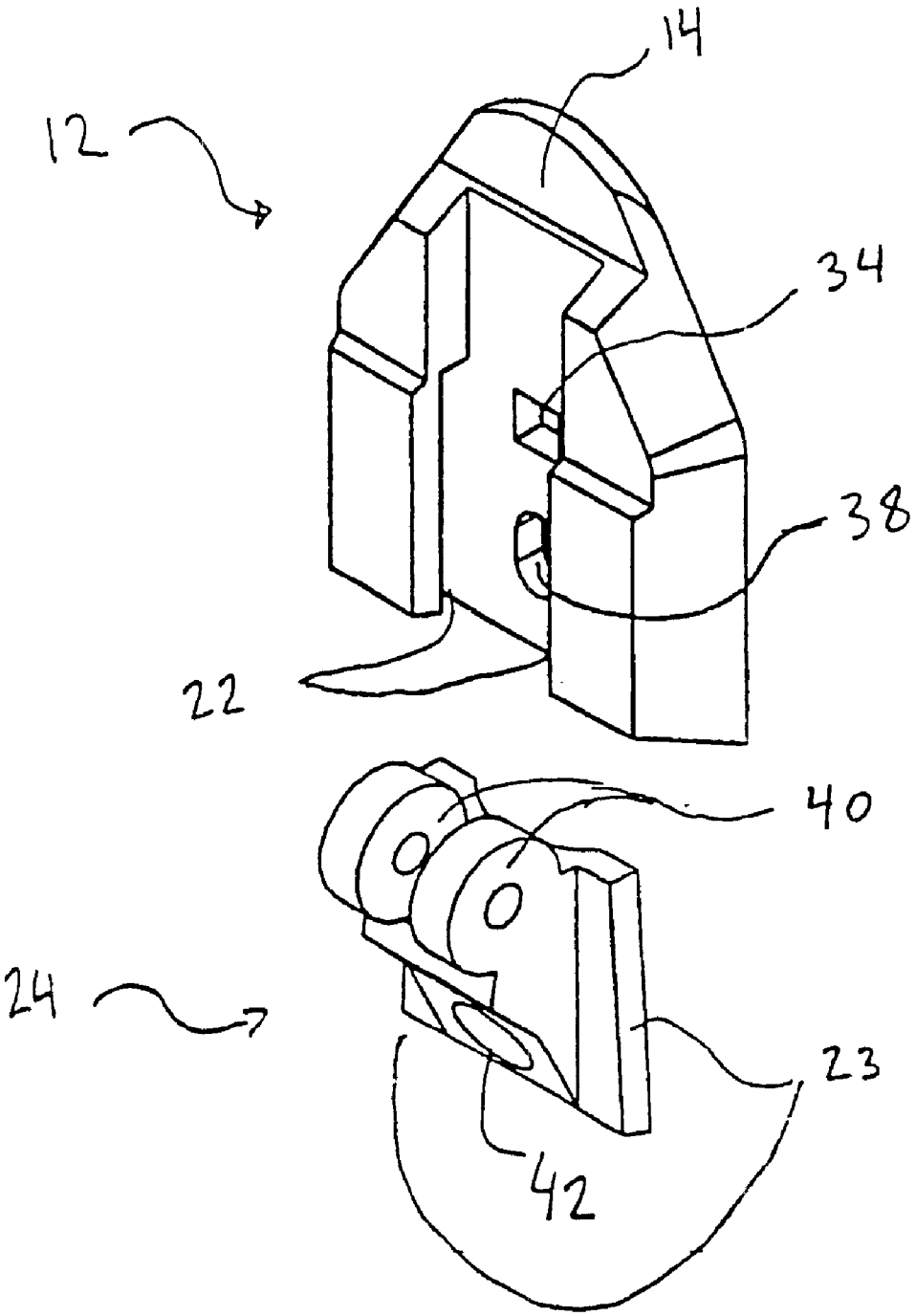
FIG. 5 is a perspective exploded view of the anchorage and the removable support.
Figure 6:
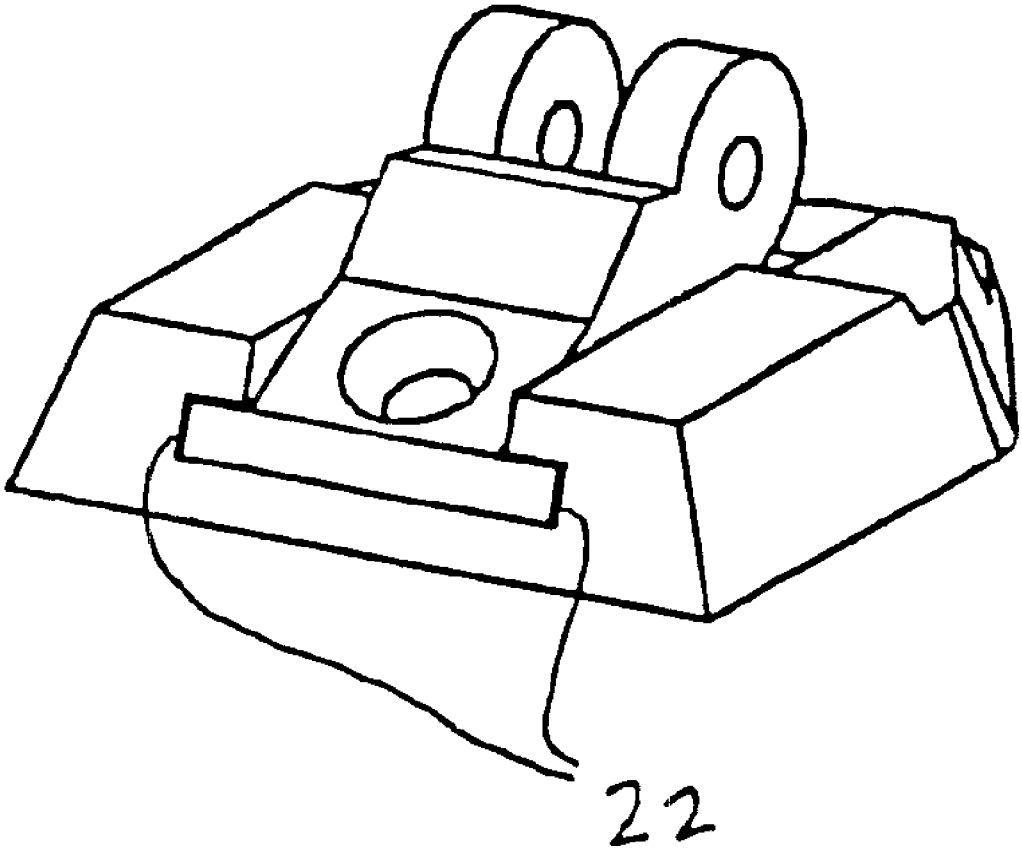
FIG. 6 is a perspective view of the removable support engaged in the anchorage.

The invention thus concerns a removable handle assembly of handle mechanism 10 for a casket, which, as shown in FIGS. 1, 5, and 6, comprises an anchorage 12, a removable support 24, and a handle 28. The handle 28 is pivotally attached to the support 24.

As seen more precisely on FIG. 5, the anchorage 12 has a front side 14 and a back side 16 which is fixedly attached to a surface 18. The anchorage further comprises a top and a bottom defined by two opposite ends. Referring back to FIGS. 1 and 5, the anchorage may further comprise a first opening 34 for receiving a fastener for securing each anchorage on the surface 18. In the illustrated embodiment, the fastener comprises a bolt 30 and a nut 32 also known as a "carriage bolt". The bolt 30 and nut 32 combination allows the anchorage 12 to be strongly attached on the outside of the casket from the inside.

The anchorage 12 also has two opposite ends 20. One of the opposite ends is provided with longitudinal grooves 22. In the present embodiment of the invention, the grooves of the anchorage are located on a lower end and face downwards when the anchorage 12 is fixed on the casket, but to those skilled in the art, it should be apparent that one could position the grooves in any suitable location as long as they allow to hold a sliding support 24 or bracket in the anchorage by preventing an orthogonal and/or lateral displacement of the support 24. The front part 14 of the anchorage 12 is partially covered by the support 24 or bracket. It should be noted that a stopper should be provided on the anchorage to prevent complete movement of the support. In the illustrated embodiment, an abutment on the anchorage 12, extending at the extremity of the grooves prevents the support from sliding further inside the grooves.

As best seen in FIGS. 5 and 6, the support also has a front and back sides. The back side is adapted to mate with the front side of the anchorage. The support 24 has a generally rectangular shape, which allows the support 24 to slide into the longitudinal grooves 22. The support 24 slides into the grooves 22 by means of lateral railings 23, engaging the support into the grooves 22 of the anchorage 12.

The support also comprises an opening 42 for receiving a lock for locking each support on an anchorage. The opening 42 is positioned on the support 24 so that when the latter is mounted in place on the corresponding anchorage 12, the opening 42 is in registry with an opening 38 located on the anchorage. The lock may be a screw 44. The screw 44 is inserted from the outside of the surface 18 through the opening 42 of the support 24 and the opening 38 of the anchorage 12 into the surface 18 for securing the support 24 in place. Thus, the opening allows the passing of the screw 44 through the anchorage 12 and the surface 18.

As further seen in the illustrated embodiment, the support further comprises a hinge for pivotally connecting the handle. The hinge 40 protrudes outwardly from the anchorage 12 when the support 24 is in place. The hinge 40 has an axis of rotation orthogonal to the sliding direction of the support 24. It should be understood that any other types of connector suitable for connecting a handle to a support in the context of the present invention are acceptable. In the illustrated embodiment, one end of the handle extends beyond the axis of the pivot such that this end 46 abuts on the head 36 of the bolt 30 when the handle 28 is pivoted.

In a second preferred embodiment, the handle mechanism may be provided with an anchorage that is integrally formed with the surface, thereby forming a receiving surface for receiving a removable support.

As mentioned hereinabove, the removable handle mechanism of the present invention is designed to be used on a coffin. Accordingly, the surface 18 can be the side of a casket. The anchorage 12 is intended to be permanently attached on the casket. The head of the screw 44 is on the outside of the casket and the bolt 30 is fixed from the inside. As seen in FIG. 1, the head 36 of the bolt 30 projects outwardly slightly from the front surface of the anchorage. Consequently, the support 24 is preferably provided with a recess to prevent interference from the head 36. Alternatively, the head 36 could be recessed in the anchorage, to achieve the same result. Therefore, the present invention also provides a removable handle mechanism for a coffin having two opposite side and two opposite ends. Such removable handle mechanism has all the features as presented hereinabove.

Figure 2:
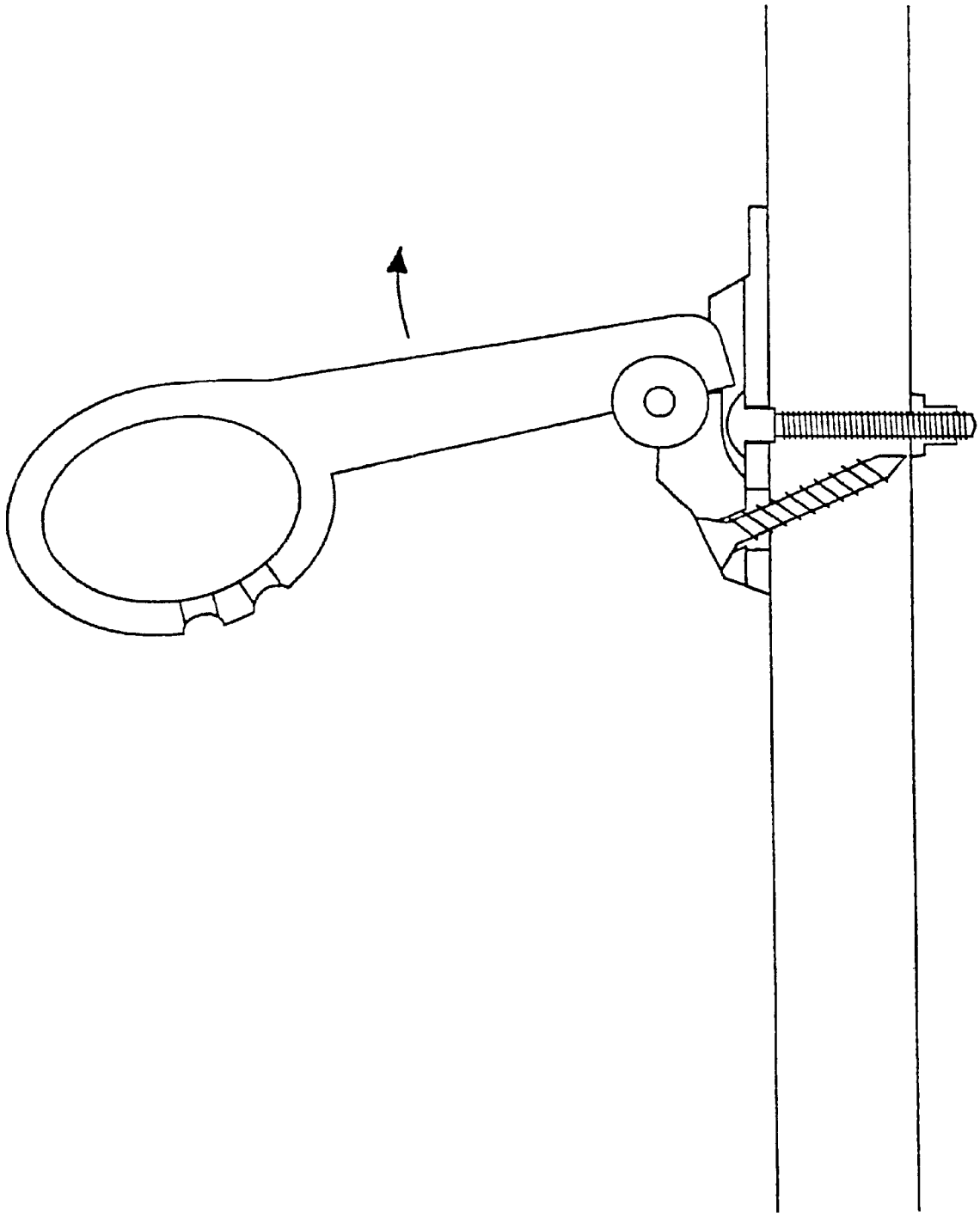
FIG. 2 is a side elevation view of the handle mechanism wherein the handle is pivoted upwards.
Figure 3:
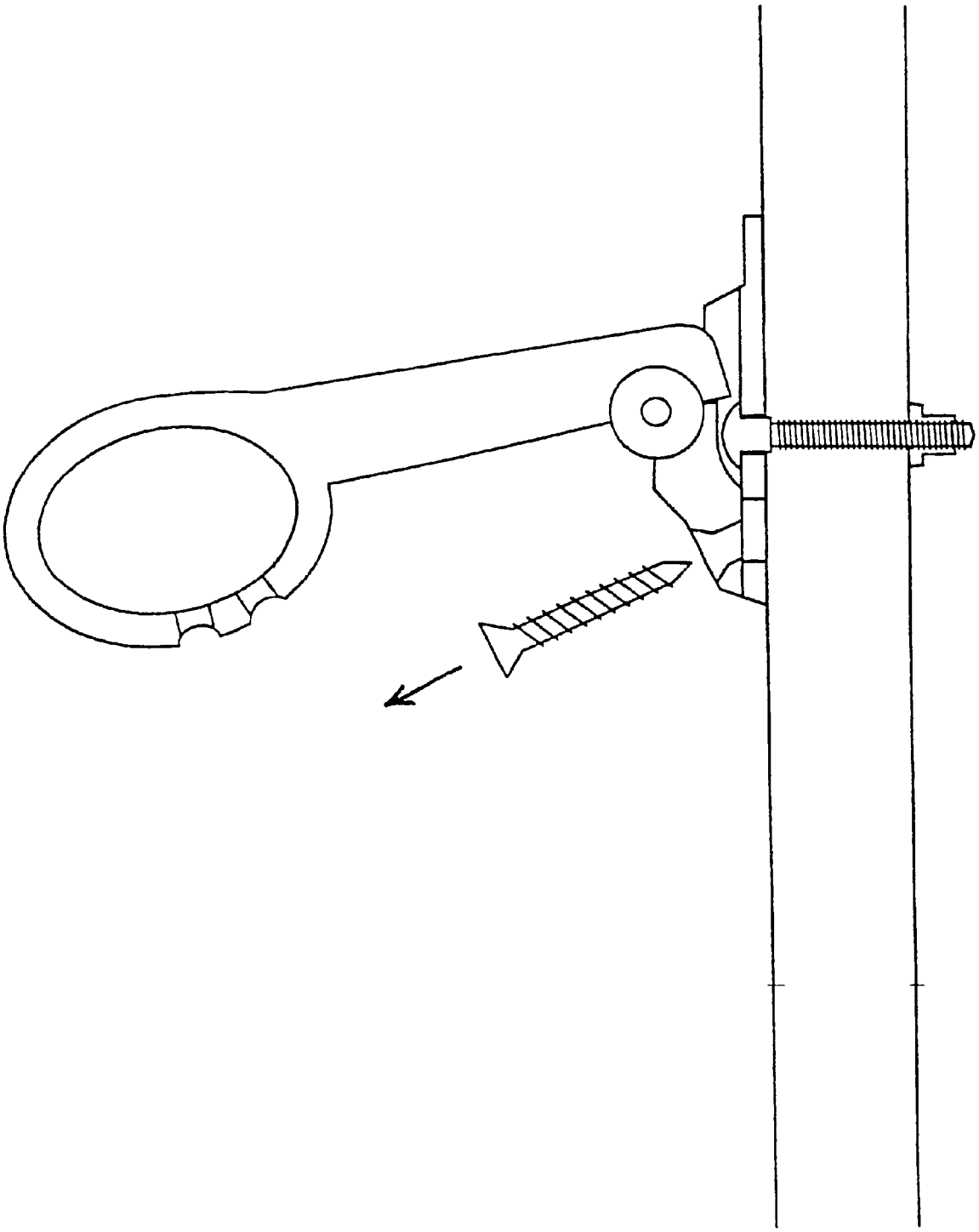
FIG. 3 is a side elevation view of the handle mechanism wherein a holding screw is removed.
Figure 4:
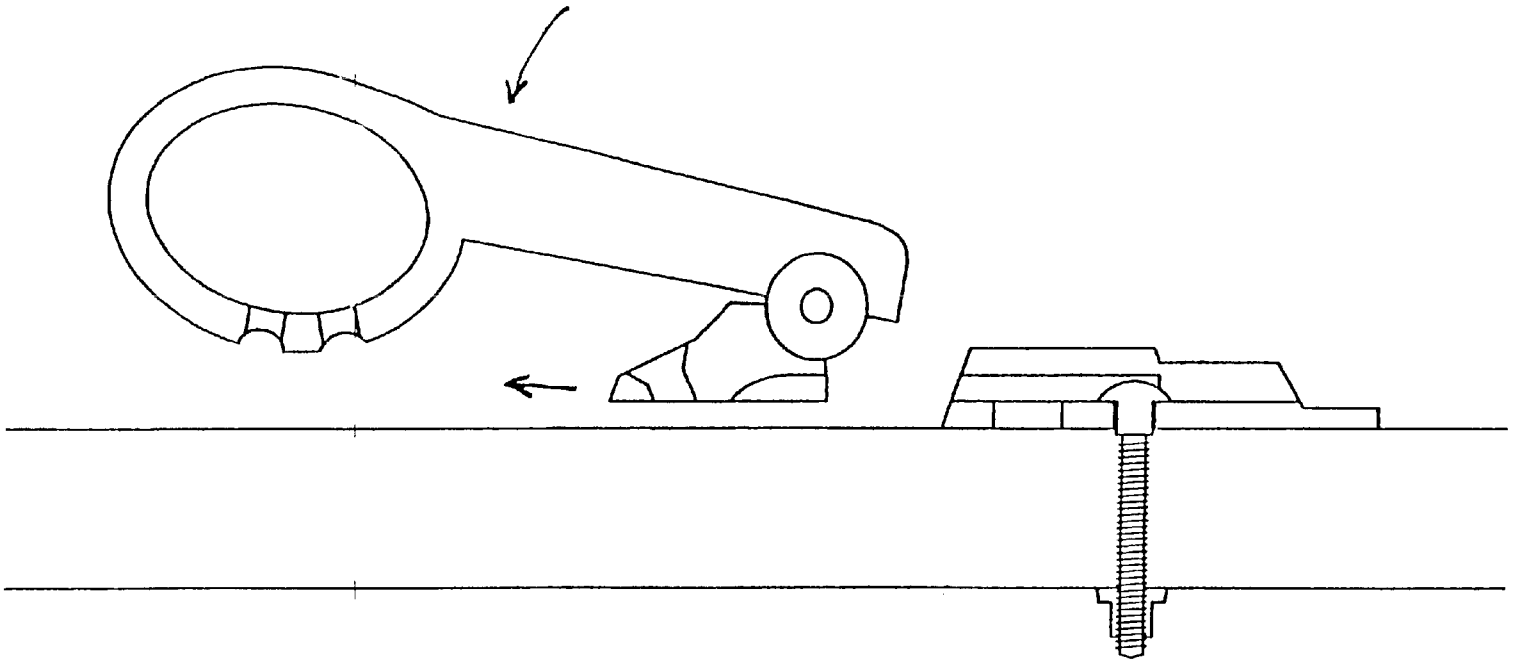
FIG. 4 is a side elevation view of the handle mechanism wherein the handle is removed.

Referring now to FIGS. 2, 3, and 4, it can be seen how the handle 28 and sliding support 24 can be removed from the anchorage 12.

As shown in FIG. 2, the first step in removing the handle 28 is to pivot the handle 24 upwards. The screw 44 now becomes accessible for removal.

Referring now to FIG. 3, the second step in removing the handle 28 is to remove the screw 44. As explained above, the head of the bolt 36 blocks the end 46 of the handle which prevents the support from sliding and handle 28 from falling during the removal thereof.

Referring now to FIG. 4, the third and last step in removing the handle 28 is to bring down the handle 28 first and then slide down the sliding support 24.

Referring back to FIG. 2, when the handle 28 is in place on the support 24 and the support 24 is in place in the anchorage 12, the handle can be pivoted upwards allowing for the transportation of the casket. The handle is pivoted downwards when the casket is at rest, thus allowing for a reduction of the space occupied by the casket.

Figure 7:
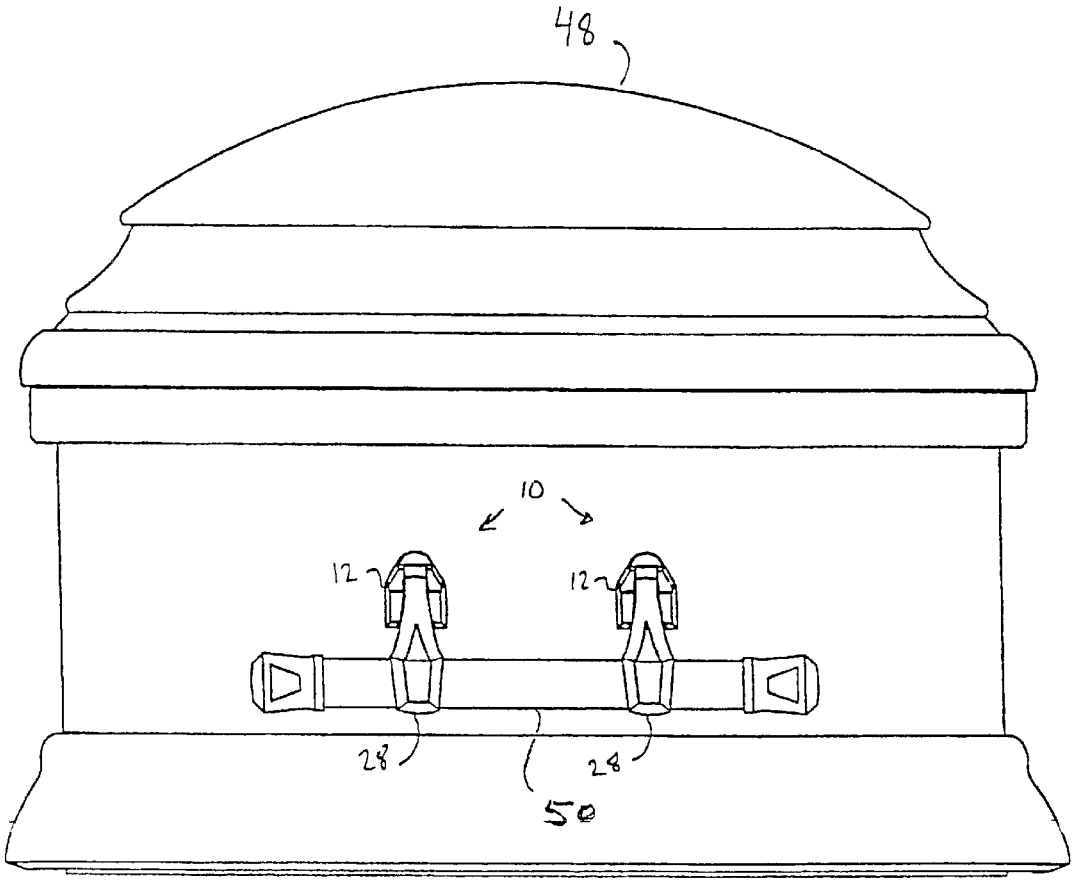
FIG. 7 is front view of a casket with the handle mechanism.

Referring now to FIG. 7, the handle mechanisms 10 can be seen to be installed on a regular casket 48. The handles 28 are held together by a holding bar 50 used for lifting the casket 48.

Figure 8:
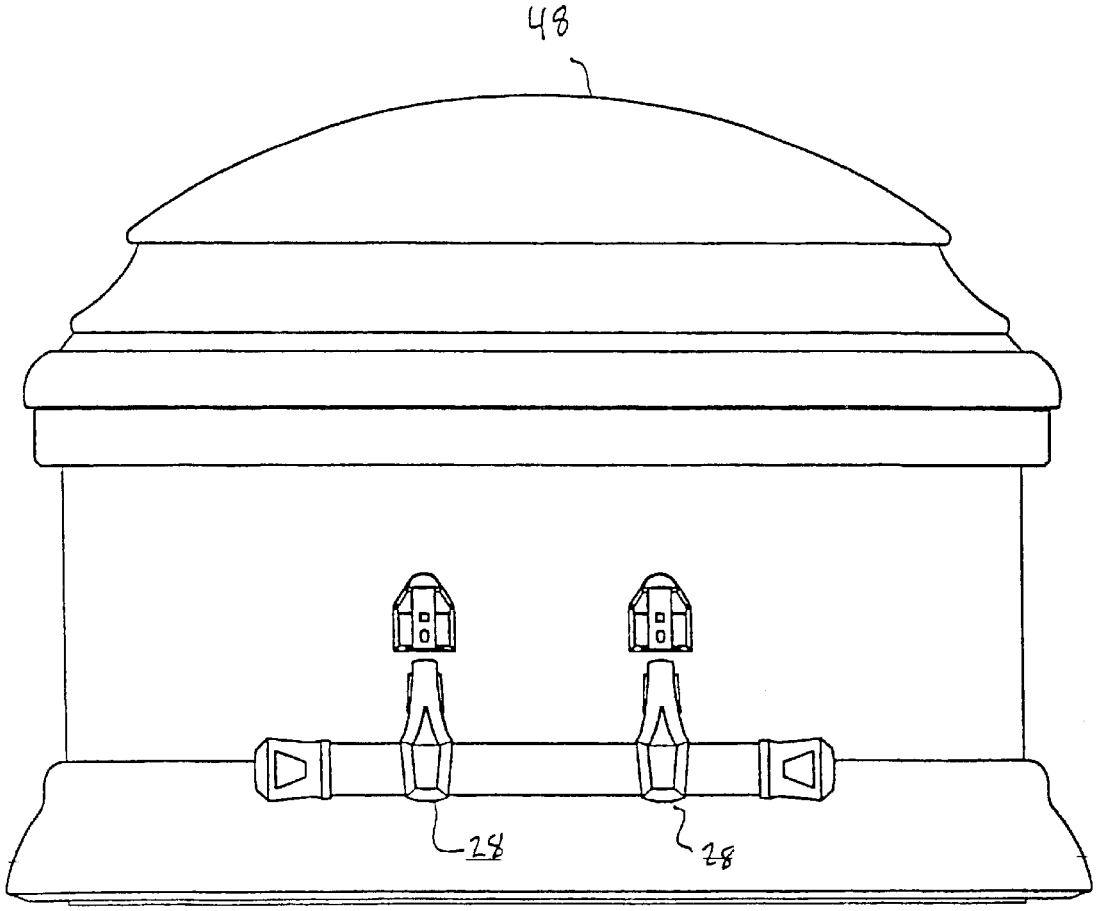
FIG. 8 is a front view of a casket with the handles being removed.

Referring now to FIG. 8, the handles 28 are shown to be removed. Such is done by following the removal steps shown in FIGS. 2, 3, and 4 described above.

The handle mechanism 10 can be used on various type of surfaces, like wood or metal. Different type of screws or bolts can be used. In the present embodiment, the screws are preferably wood screws of appropriate size. The carriage bolt is preferably and made of steel and of appropriate size. Other type of screws can obviously be used, depending on the size of the handle mechanism.

Preferably, the material used for the anchorage, sliding support, and handle is injection molded zinc. Of course, other suitable materials can be used.

Although a preferred embodiment of the method and apparatus of the present invention has been illustrated in the accompanying drawings and described in the foregoing detailed description, it will be understood that the invention is not limited to the embodiment disclosed, but is capable of numerous rearrangements, modifications and substitutions without departing from the spirit of the invention as set forth and defined by the following claims.

What is claimed is:

1. A removable handle mechanism, comprising:

at least one anchorage having a front and a back side, the back side adapted to be fixedly secured to a surface, each of the at least one anchorage further having two opposite ends, the front side of each of the at least one anchorage having therein, at one of the opposite ends, a set of longitudinal grooves, at least one removable support adapted to be slideably received in the set of longitudinal grooves in the front side of each of the at least one anchorage;

a lock for locking each of the at least one support on the front side of each of said at least one anchorage; and a handle pivotally connected to each of the at least one support.

2. A removable handle mechanism according to claim 1, wherein each of the at least one anchorage has a top and a bottom and the longitudinal grooves are located on a lower end of each of the at least one anchorage.

3. A removable handle mechanism according to claim 1, wherein each of the at least one anchorage further comprises a first opening for receiving a fastener for securing each of the at least one anchorage on the surface.

4. A removable handle mechanism according to claim 1, wherein the fastener comprises a bolt and a nut.

5. A removable handle mechanism according to claim 1, wherein each of the at least one support comprises an opening for receiving the lock for securing each of the at least one support on the front side of each of the at least one anchorage, the opening being positioned on each of the at least one support so that when it is mounted in place on each of the at least one anchorage, the opening is in registry with an opening located on each of the at least one anchorage.

6. A removable handle mechanism according to claim 1, wherein the handle is pivotally connected to each of the at least one support by a hinge.

7. A removable handle mechanism according to claim 1, wherein the lock comprises a screw.

8. A removable handle mechanism according to claim 1, wherein each of the at least one anchorage, support and handle are made of injection moulded zinc.

9. A removable handle mechanism for a coffin, said coffin having two opposite sides and two opposite ends, said removable handle mechanism, comprising:

at least one anchorage on each opposite side, each of said at least one anchorage having a front and a back side, the back side adapted to be fixedly secured to a wall surface of the coffin, each of the at least one anchorage further having two opposite ends, the front side of each of the at least one anchorage having therein, at one of the opposite ends, a set of longitudinal grooves;

at least one support adapted to be slideably received in the set of longitudinal grooves in the front side of each of said at least one anchorage;

a lock for locking each of the at least one support on the front side of each of the at least one anchorage; and a handle pivotally connected to the support.

10. A removable handle mechanism according to claim 9, wherein the grooves are located on a lower end of each of the at least one anchorage.

11. A removable handle-mechanism according to claim 9, wherein each of the at least one anchorage further comprises a first opening for receiving a fastener for securing each of the at least one anchorage on the wall surface of the coffin.

12. A removable handle mechanism according to claim 11, wherein the fastener comprises a bolt and a nut.

13. A removable handle mechanism according to claim 9, wherein each of the at least one support comprises an opening for receiving the lock for securing each of the at least one support on the front side of the anchorage, the opening being positioned on each of the at least one support so that when it is mounted in place on each of the at least one anchorage, the opening is in registry with an opening located on each of the at least one anchorage.

14. A removable handle mechanism according to claim 9, wherein the handle is pivotally connected to each of the at least one support by a hinge.

15. A removable handle mechanism according to claim 9, wherein the lock comprises a screw.

16. A removable handle mechanism, comprising:

at least one anchorage integrally formed with a receiving surface, each of the at least one anchorage having two opposite ends, the front side of each of the at least one anchorage having therein, at one of the opposite ends, a set of longitudinal grooves;

at least one support adapted to be slideably received in the set of longitudinal grooves in the receiving surface of the at least one anchorage;

a lock for locking each of the at least one support on the front side of each of the at least one anchorage; and a handle pivotally connected to the support.

17. A removable handle mechanism according to claim 16, wherein each of the at least one support comprises an opening for receiving the lock for securing each of the at least one support on the front side of the each of the at least one anchorage, the opening being positioned on each of the at least one support so that when each of the at least one support is mounted in place on each of the at least one anchorage, the opening is in registry with an opening located on each of the at least one anchorage.

18. A removable handle mechanism according to claim 16, wherein the handle is pivotally connected to each of the at least one support by a hinge.

19. A removable handle mechanism according to claim 16, wherein the lock for locking each of the at least one support to each of the at least one anchorage comprises a screw.

20. A removable handle mechanism, comprising:

at least one anchorage having a front and a back side, the back side being adapted to be fixedly secured to a surface, each of the at least one anchorage further having an upper and a lower ends, the lower end being provided with a set of grooves, each of the at least one anchorage further comprising an opening for receiving a fastener for securing each of the at least one anchorage on the surface, the fastener comprising a bolt and a nut;

at least one support adapted to be inserted in the grooves located on the front side of each of the at least one anchorage;

a lock for locking each of the at least one support on the front side of each anchorage, the lock comprising a screw; and a handle pivotally connected to each of the at least one support by a hinge.

* * * * *

UNITED STATES PATENT AND TRADEMARK OFFICE

CERTIFICATE OF CORRECTION

PATENT NO. : 6,499,193 B1
DATED : December 31, 2002
INVENTOR(S) : Pascal Robert

It is certified that error appears in the above-identified patent and that said Letters Patent is hereby corrected as shown below:

Title page,
Insert Item:

-- [30] Foreign Application Priority Data
October 29, 1999 (CA) 2,287,739 --

Signed and Sealed this

Fifteenth Day of April, 2003

JAMES E. ROGAN
*Director of the United States Patent and Trademark Office*